US005947816A

United States Patent [19]

Schiedegger et al.

[11] Patent Number: 5,947,816

[45] Date of Patent: Sep. 7, 1999

[54] MODULAR SOFFIT VENT

[75] Inventors: Charles E. Schiedegger, Metamora; Mark T. MacLeod, Rochester Hills; Michael C. Clark, Columbiaville, all of Mich.

[73] Assignee: Tapco International Corporation, Plymouth, Mich.

[21] Appl. No.: 09/132,272

[22] Filed: Aug. 11, 1998

Related U.S. Application Data

[63] Continuation of application No. 08/554,889, Nov. 9, 1995, Pat. No. 5,791,985, which is a continuation-in-part of application No. 08/468,191, Jun. 6, 1995, abandoned.

[51] Int. Cl.[6] ..... F23L 17/12; F24F 7/06

[52] U.S. Cl. ..... 454/339; 454/241; 454/368

[58] Field of Search ..... 454/35, 199, 260, 454/339, 341, 355, 356, 367, 368

[56] References Cited

U.S. PATENT DOCUMENTS

| | | | |
|---|---|---|---|
| 2,826,136 | 3/1958 | Smith | 454/368 |
| 4,090,436 | 5/1978 | Wright | 454/368 X |
| 4,201,121 | 5/1980 | Brandenburg, Jr. | 454/341 X |
| 4,407,100 | 10/1983 | Huelsekopf . | |
| 4,667,581 | 5/1987 | Hovland | 454/260 |
| 4,875,318 | 10/1989 | MacLeod et al. . | |
| 4,909,135 | 3/1990 | Greko | 454/368 |
| 4,920,708 | 5/1990 | MacLeod et al. . | |
| 5,005,328 | 4/1991 | Holtgreve | 454/368 X |
| 5,009,149 | 4/1991 | MacLeod et al. | 454/365 |
| 5,133,168 | 7/1992 | Neilly et al. . | |
| 5,195,283 | 3/1993 | MacLeod et al. . | |
| 5,243,793 | 9/1993 | MacLeod et al. . | |
| 5,297,004 | 3/1994 | Mazura | 454/358 |
| 5,326,060 | 7/1994 | Chubb et al. . | |
| 5,435,780 | 7/1995 | Ayles | 454/199 |
| 5,561,952 | 10/1996 | Damron | 454/367 X |

FOREIGN PATENT DOCUMENTS

| | | | |
|---|---|---|---|
| 57-166435 | 10/1982 | Japan | 454/260 |
| 440129 | 12/1935 | United Kingdom | 454/339 |

*Primary Examiner*—Harold Joyce
*Attorney, Agent, or Firm*—Howard & Howard

[57] ABSTRACT

A vent apparatus for cooperating with duct work associated with an exhaust fan to enable air to be exhausted from an interior room of a dwelling to the exterior environment. The vent apparatus includes a base member and a cover member releasably securable to the base member. The base member includes an attaching portion having a plurality of locking portions, while the cover member includes a plurality of flexible latching arm members which releasably engage the locking portions when the cover member is placed over the attaching portion. The attaching portion includes an enlarged opening which enables air exhausted from an interior room to be directed out between the base and cover members to the exterior atmosphere. The apparatus is particularly well-adapted to be used with vinyl or aluminum siding and is relatively inexpensive to construct, light-weight and easy to install. In an alternative embodiment, the apparatus includes a screen adapted to be secured to the base member. The screen has dimensions which enable it to fit within the cover member so as not to be visible once the cover is installed on the base member. The screen prevents insects and small mammals from entering through the base member. The screen is secured to the base member via a plurality of locking arm members which engage within openings formed in the base member such that the screen can be "snapped" onto the base member without special tools or external fastening elements such as threaded screws or the like.

33 Claims, 9 Drawing Sheets

FIG 7
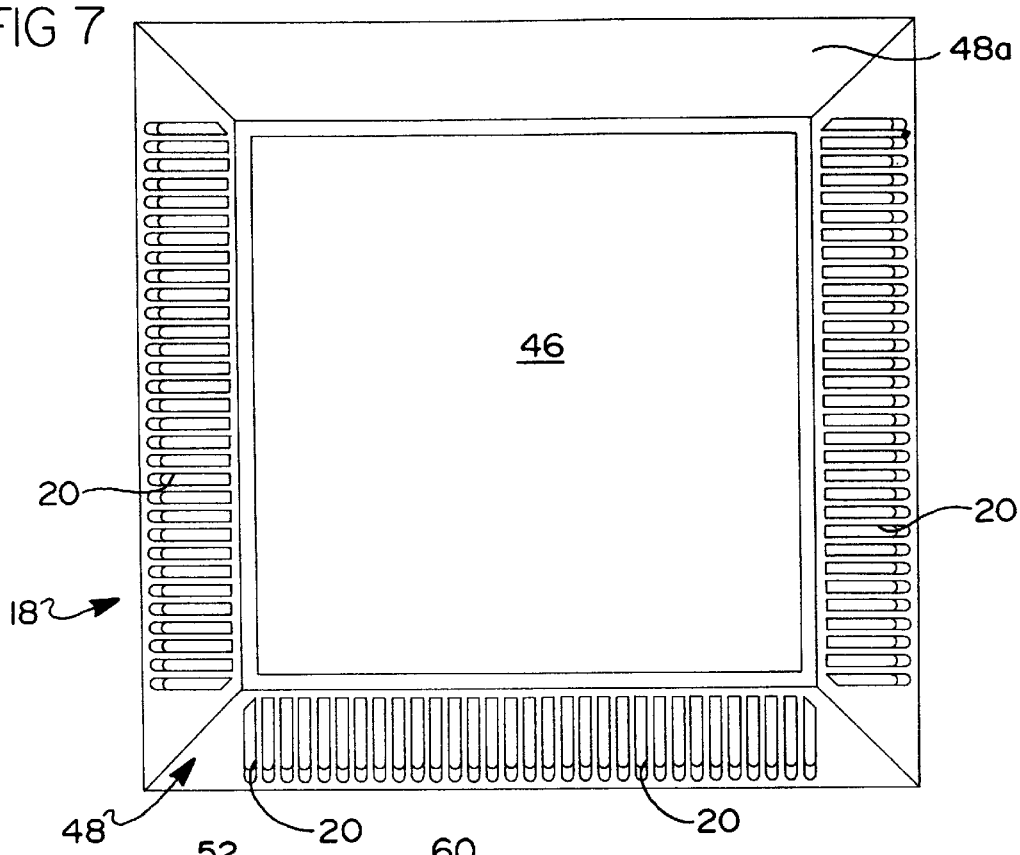
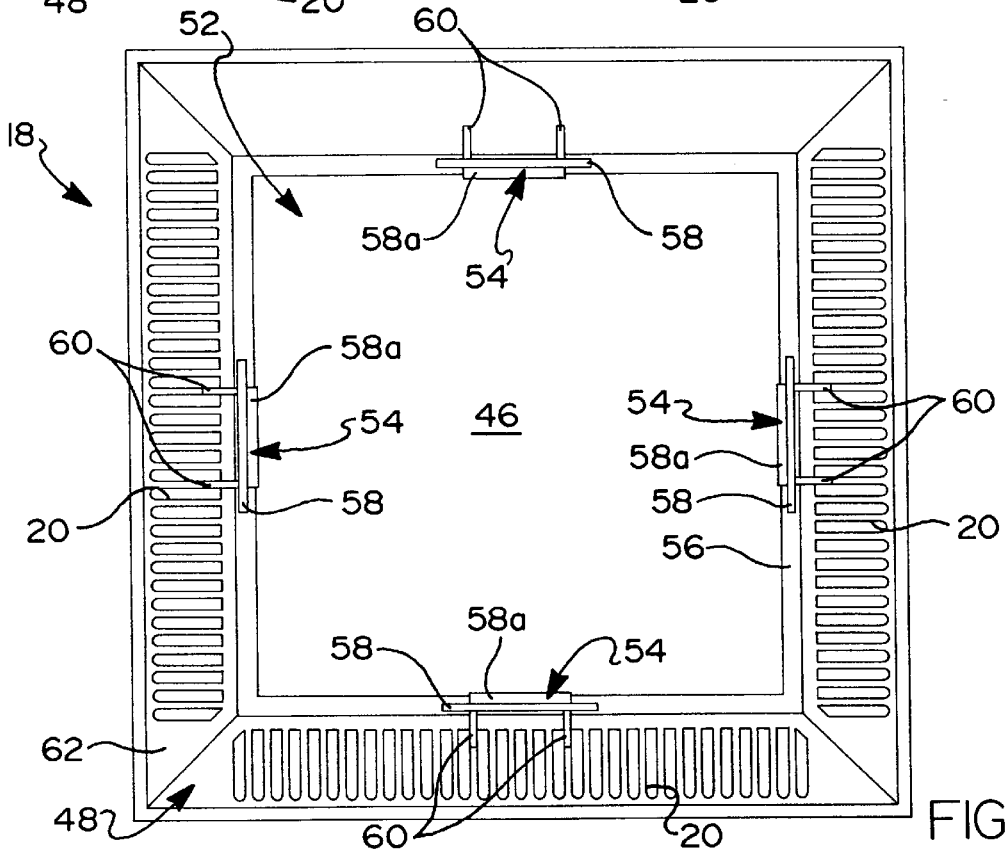
FIG 8

FIG 9
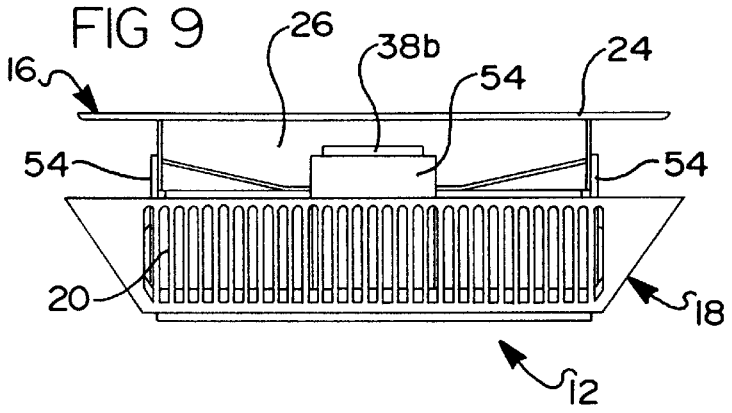
FIG 10
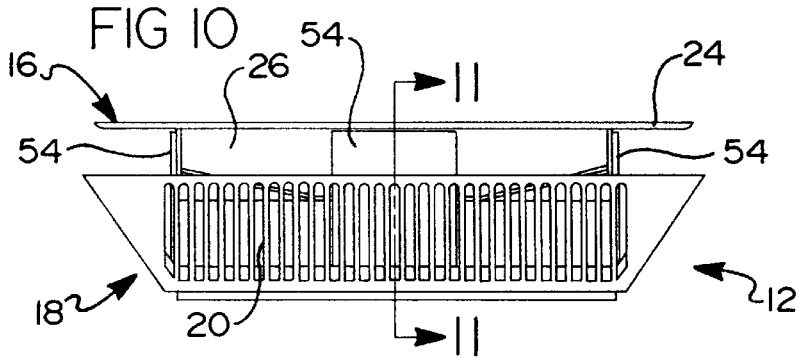
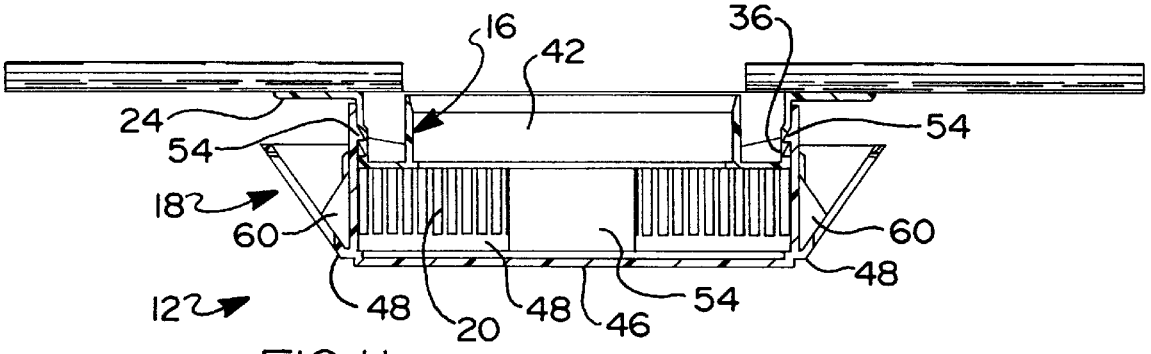
FIG 11

FIG 14
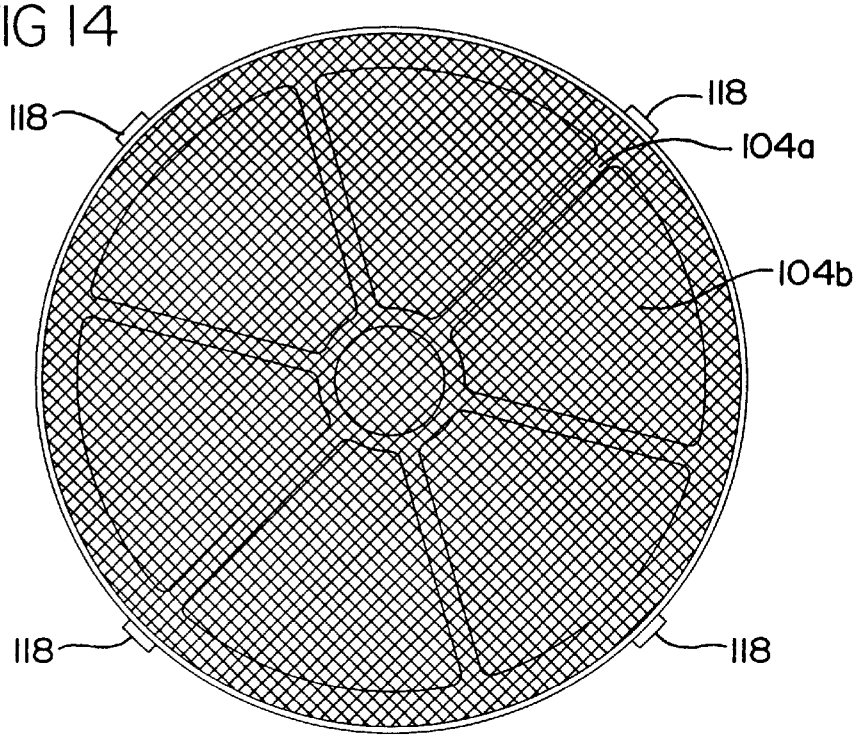
FIG 15
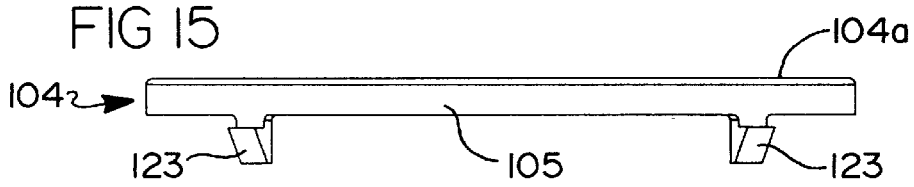
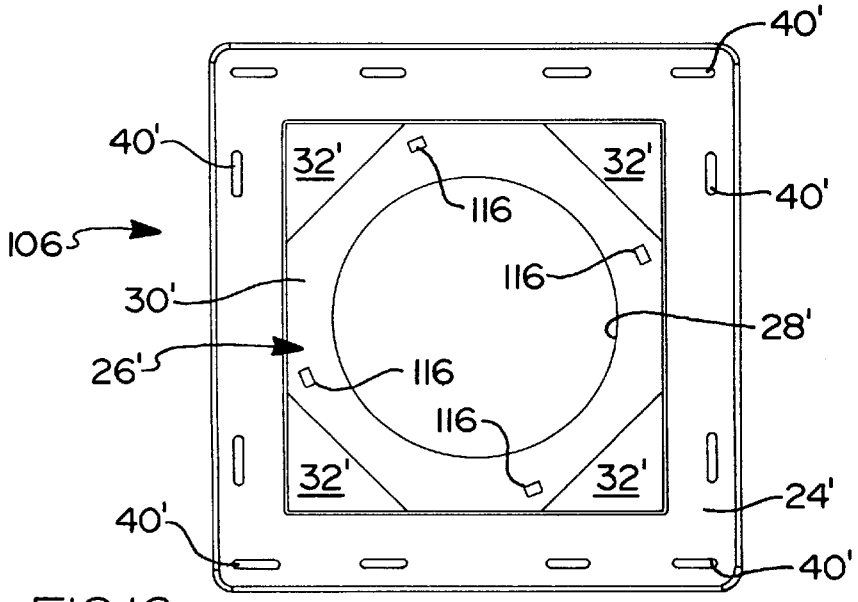
FIG 16

MODULAR SOFFIT VENT

CROSS-REFERENCE TO RELATED APPLICATIONS

The subject matter of the present application is a continuation of U.S. patent application Ser. No. 08/554,889, filed Nov. 9, 1995, U.S. Pat. No. 5,791,985, which is a continuation-in-part of U.S. patent application Ser. No. 08/468,191, filed Jun. 6, 1995 abandoned, and entitled "Component Soffit Vent Apparatus", assigned to the assignee of the present application.

BACKGROUND OF THE INVENTION

1. Technical Field

This invention relates to vent assemblies, and more particularly to a component soffit vent apparatus.

2. Discussion

A variety of vent apparatuses are typically used in residential and commercial dwellings to allow ventilation of attics and other interior areas of the dwelling. In the past, with the bathroom areas of dwellings, it was common to vent air exhausted from a bathroom via a bathroom fan through duct work into an attic or other like area of a dwelling, and to allow the exhausted air to escape to the external environment through one or more roof vents or soffit vents associated with the roof of the dwelling.

Recently, building codes have been amended to require the air exhausted via a bathroom fan to be exhausted through an independent, dedicated vent. Hence, it is no longer permissible in many cities to vent air exhausted from a bathroom exhaust fan directly into an attic of the dwelling.

While various vent apparatuses exist which may be attached to an exterior surface of the dwelling such as a soffit and communicate with an exhaust fan disposed within one of the rooms of the dwelling, such apparatuses have often been somewhat cumbersome to install, expensive, or have added to the complexity of installing vinyl or aluminum siding in the area surrounding that where the vent apparatus is placed. In addition, many previously developed vent apparatuses are not easily suited to be retrofitted to existing dwellings when an additional interior exhaust fan is added to the dwelling that necessitates an independent vent for dedicated use therewith.

Accordingly, it is a principal object of the present invention to provide a soffit vent apparatus for use with an interior exhaust fan of a building such as a dwelling, which may be easily and quickly secured to an exterior surface of the dwelling such as a soffit.

It is another object of the present invention to provide a soffit vent apparatus which includes two component parts, one of which may be secured directly to an exterior surface of a building such as a soffit thereof, and the second part of which may be quickly and easily secured to the first part without the need for additional external fasteners or complicated assembly steps.

It is still a further object of the present invention to provide a soffit vent apparatus which may be positioned on a horizontally extending soffit of a building such as a dwelling, or alternatively, positioned on a vertically extending exterior surface of a building, to enable the exhausting of air from an interior exhaust fan of the building.

It is still another object of the present invention to provide a soffit vent apparatus which is well-suited to enabling the exhausting of air from an interior exhaust fan of a building, and which further is of a construction which enables it to be secured to an exterior surface of the building without complicating the addition of vinyl or aluminum siding to the areas immediately adjacent the vent apparatus.

It is still another object of the present invention to provide a soffit vent apparatus which is relatively inexpensive and easily constructed from conventional molding techniques, which is light-weight, resists weathering and the elements, and which may be installed on an exterior surface of the building with conventional fastening elements such as nails or wood screws.

SUMMARY OF THE INVENTION

The above and other objects are provided by a soffit vent apparatus in accordance with the preferred embodiments of the present invention. The apparatus comprises a base member having a securing flange and an attaching portion. The securing flange includes one or more openings for enabling the securing flange to be secured to an exterior surface of a building via conventional nails or wood screws. The attaching portion includes an opening of a suitable diameter to communicate with duct work associated with an exhaust fan disposed within an interior room of the building. One or more locking portions are also formed on the attaching portion.

An independent cover member is releasably securable to the base member via one or more securing members. The securing members preferably protrude from an interior surface of the cover member and interengage with the one or more locking portions of the base member to hold the cover member to the base member in spaced-apart relationship to enable exhaust air exiting the opening in the base member to pass out to the exterior environment between the base member and the interior of the cover member. The cover member is preferably of dimensions which enable it to completely cover the base member, thereby providing a decorative appearance and concealing the fastening elements securing the base member to the exterior surface of the building.

In a preferred embodiment, the attaching portion includes an uppermost surface having a generally square-shape and a plurality of corner portions sloping downwardly towards the securing flange. The downwardly sloping corner portions provide further clearance between the cover member and the base member when the cover member is secured to the base member, thereby enhancing the ease with which air may be exhausted through the opening, between the base member and the cover member, and to the external environment.

In a preferred embodiment, the attaching portion of the base member further includes a plurality of locking portions, with each locking portion including a plurality of integrally formed shoulder portions. In this preferred embodiment, a plurality of securing members are formed on an interior surface of the cover member. Each securing member comprises a flexible latching arm which is releasably engageable with an associated shoulder portion on the base member. The latching arms and the shoulder portions thus allow the cover member to be adjustably positioned in spaced-apart relationship to the base member to provide an adjustable degree of clearance between the cover member and the base member.

In another preferred embodiment, the cover member includes a central portion and an angled peripheral portion. The peripheral portion is preferably angled such that it slopes downwardly towards the securing flange of the base portion. The peripheral portion includes a plurality of ventilation slots to even further increase the ease with which air may be exhausted to the exterior environment.

In an alternative preferred embodiment, the soffit vent apparatus comprises a base member which is securable to the exterior of a building over an opening in the exterior surface of the building. A screen is releasably secured to a portion of the base member. A cover member is releasably secured to the base member in spaced-apart relationship to the screen so as to enclose the screen. The screen prevents the entry of relatively small insects and other small mammals into the opening of the building.

In the just-described alternative preferred embodiment, the base member further includes a cylindrical member secured to the base member so as to protrude toward the opening in the building. The cylindrical member is of a diameter sufficient to accept duct work having a diameter up to at least about four inches. If duct work having a diameter of less than four inches is to be covered by the apparatus, then the apparatus is able to be used with an adapter member for mating the cylindrical member to the duct work. Accordingly, through the use of the adapter member, the soffit vent can be used to communicate with duct work having a diameter approximately equal to that of the cylindrical member or less than the diameter of the cylindrical member.

In each of the preferred embodiments, the base member and the cover member are molded through conventional molding techniques, and preferably injection molded, from a thermoplastic. The base member and cover member each form light-weight, yet rigid and strong component parts which are resistant to corrosion and the elements, and further which will not splinter, crack or otherwise show visible signs of wear over prolonged periods of time.

The vent apparatus of the present invention further enables aluminum or vinyl siding to be more easily installed after the vent apparatus is secured to the exterior surface of the building. This is because the siding need not be cut to perfectly and completely cover the securing flange of the base member, since the cover member is preferably dimensioned such that it extends completely over the base member, thus concealing the entire securing flange. The vent apparatus is further retrofittable to an existing building which already has vinyl or aluminum siding thereon without requiring entire lengths of siding to be removed before securing the base member to the exterior surface of the building.

BRIEF DESCRIPTION OF THE DRAWINGS

The various advantages of the present invention will become apparent to one skilled in the art by reading the following specification and subjoined claims and by referencing the following drawings in which:

FIG. 7 is a plan view of the cover member of the vent apparatus of the present invention;

FIG. 8 is a plan view of the interior area of the vent apparatus of FIG. 7;

FIG. 9 is a side view of the cover member secured at a first mounting position to the base member;

FIG. 10 is a side view of the cover member secured to the base member in a second mounting position;

FIG. 11 is a cross-sectional side view of the assembled vent apparatus secured to the exterior surface of the building and taken in accordance with section line 11—11 of FIG. 10;

FIG. 14 is a plan view of the screen of the soffit vent apparatus shown in FIG. 13;

FIG. 15 is a side view of the screen shown in FIG. 14 in accordance with directional line 15—15 in FIG. 14;

FIG. 16 is a plan view of the base member of the apparatus of FIG. 12.

DETAILED DESCRIPTION OF THE PREFERRED EMBODIMENTS

Figure 1:
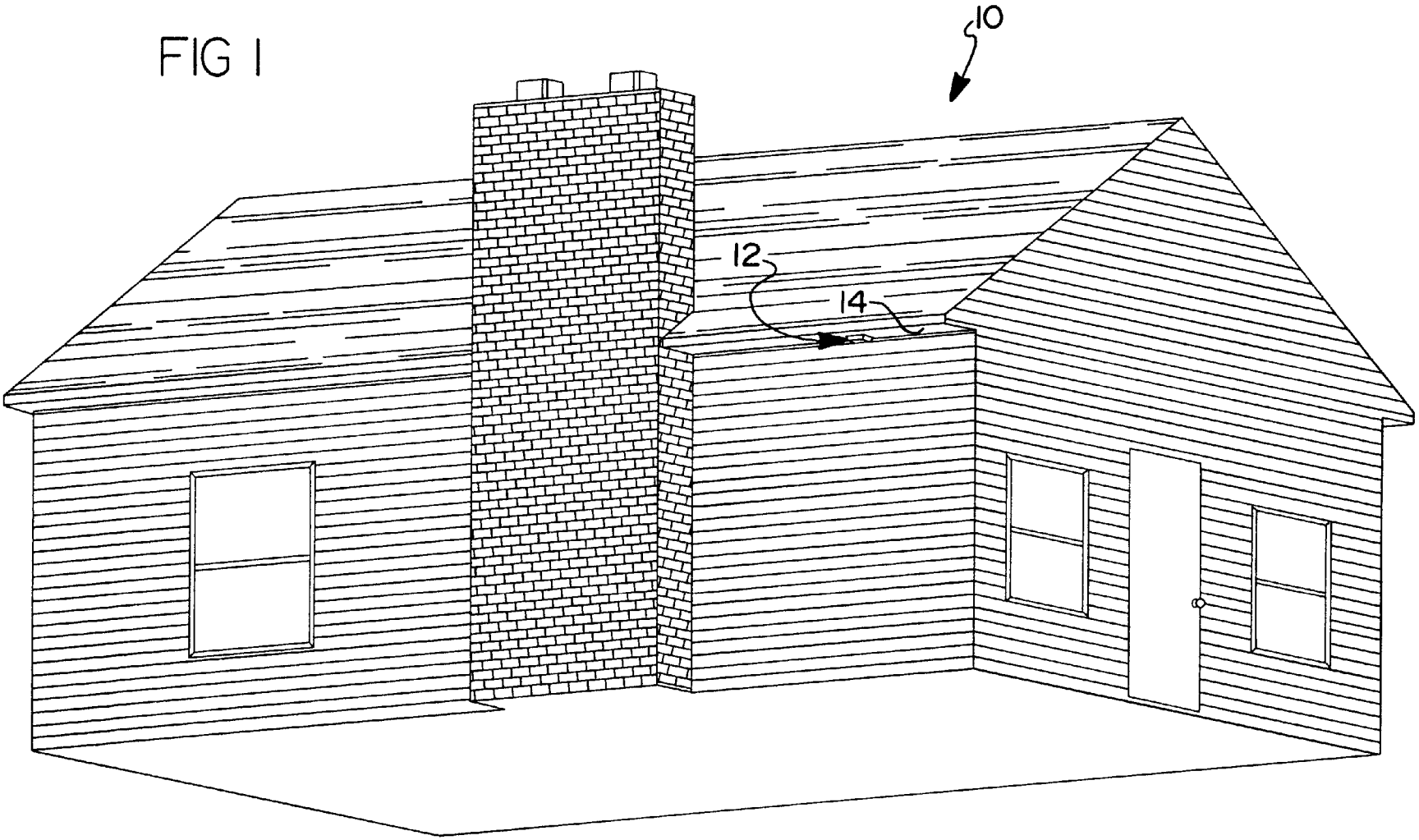
FIG. 1 is a perspective view of a building in the form of a residential dwelling having a vent apparatus in accordance with the present invention attached to a soffit of the dwelling.

Referring to FIG. 1, there is shown a building in the form of a residential dwelling 10 and a vent apparatus 12 in accordance with the present invention secured to a soffit 14 of the dwelling 10. It will be appreciated immediately, however, that the vent apparatus 12 could just as easily be secured to a vertically extending surface of the building and is not limited to placement on a soffit of a building. Thus, while the vent apparatus 12 is referred to herein as a "soffit" vent apparatus, the apparatus 12 is securable to virtually any surface of the building where it may be attached by nails or threaded screws.

The vent apparatus 12 is well adapted to communicate with the duct work of an internal exhaust fan disposed within one of the rooms within the dwelling 10. The apparatus 12 communicates with an opening cut into the soffit 14 or other surface of the dwelling 10, which is in communication with duct work leading to the exhaust fan within the dwelling, to thereby enable air exhausted from an interior room of the dwelling to pass outwardly through the duct work in the attic of the dwelling 10 and through the apparatus 12 to the outside atmosphere.

Figure 2:
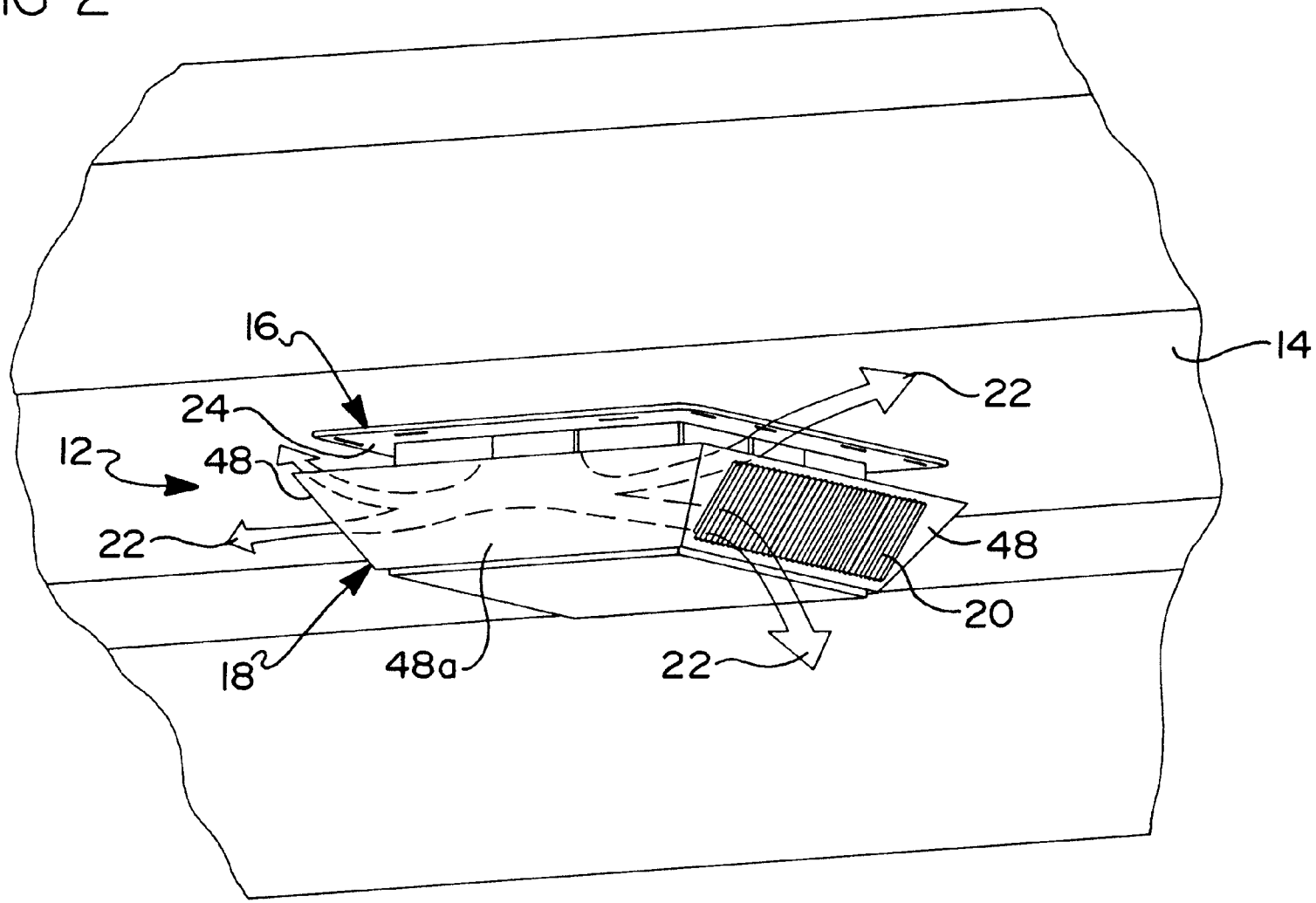
FIG. 2 is an enlarged perspective view of the vent apparatus shown in FIG. 1.

With reference to FIG. 2, the vent apparatus 12 generally comprises a base member 16 and a cover member 18 releasably securable to the base member 16. As will be explained more fully in the following paragraphs and in connection with the remaining drawing figures, the cover member 18, when secured to the base member 16, is positioned in a slightly spaced-apart relationship to the base member 16 to thereby permit air exhausted through the duct work of the dwelling to exit between the base member 16 and the cover member 18, as well as through ventilation slots 20 formed in the cover member 18, as indicated by airflow arrows 22.

Figure 3:
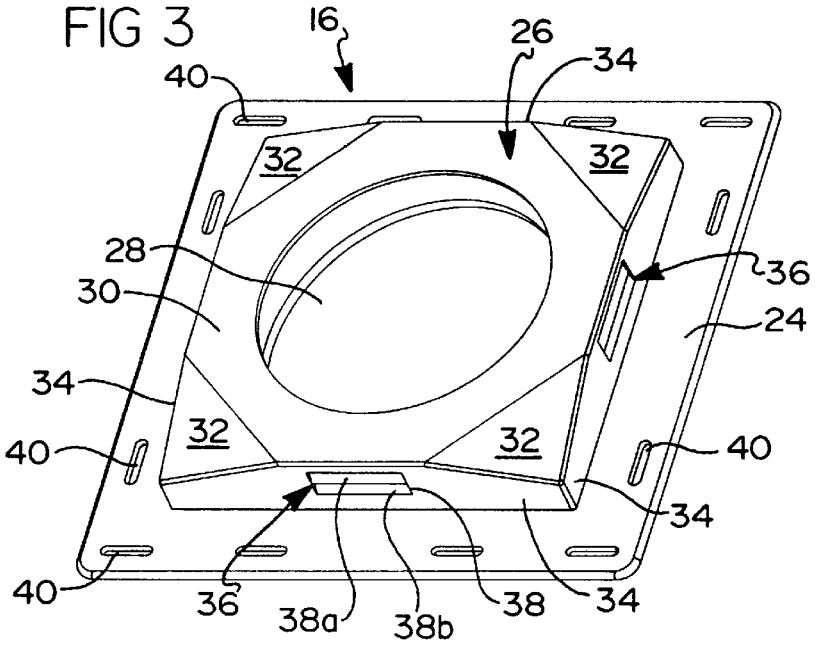
FIG. 3 is a perspective view of the base member of the present invention.
Figure 4:
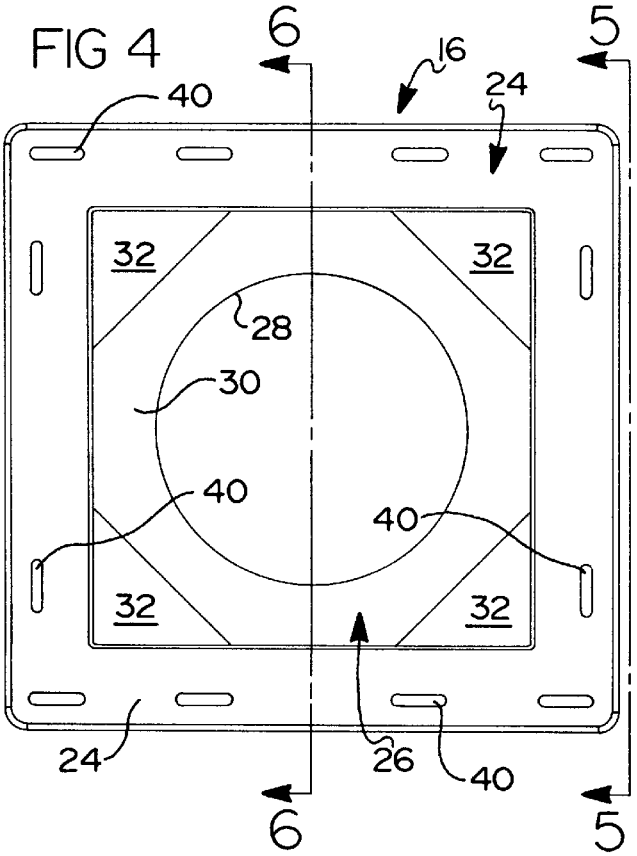
FIG. 4 is a plan view of the base member of FIG. 3.
Figure 5:
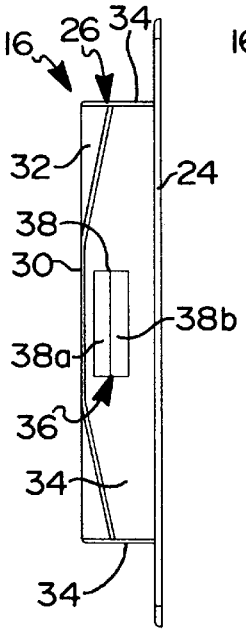
FIG. 5 is a right side view of the base member of FIG. 4 taken in accordance with directional line 5—5 of FIG. 4.
Figure 6:
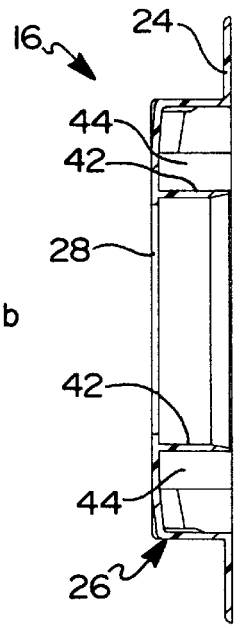
FIG. 6 is a cross-sectional view of the base member of FIG. 4 taken in accordance with section line 6—6 of FIG. 4.

Referring now to FIGS. 3–5, the base member 16 includes a generally planar securing flange 24 and an integrally formed, raised attaching portion 26. The attaching portion 26 includes a relatively large diameter opening 28 formed centrally therein, with the precise diameter of the opening 28 being variable, but preferably about 4.00 inches, to communicate with conventional ventilation duct work. The attaching portion 26 is illustrated as being generally square in shape, but may just as easily be formed of a circular, triangular, oval or other rectangular shape if so desired. The attaching portion 26 includes an uppermost surface 30 having corner portions 32 which slope downwardly towards the securing flange 24. The attaching portion 26 further includes sidewalls 34 which each include a locking portion 36 integrally formed thereon. Each locking portion 36 is comprised of a plurality of integrally formed shoulder portions 38, the function of which will be described momentarily. The securing flange 24 extends generally perpendicularly from the sidewalls 34 and includes a plurality of spaced-apart openings 40 in the form of elongated slots spaced thereabout to provide openings for nails, threaded screws or other like fasteners to pass therethrough to secure the securing flange 24 directly to the exterior surface of the soffit 14. The elongated shape of the openings 40 further provides a degree of added adjustability when positioning the base member 16 during installation, as well as for allowing for thermal expansion of the base member 16 once the base member 16 is secured to the soffit 14. With specific reference to FIG. 6, the base member 16 includes an interior circular wall portion 42 reinforced by one or more interior brace portions 44 integrally formed with the circular wall portion 42 and the uppermost surface 30.

Referring now to FIG. 7, the cover member 18 includes a central portion 46 and a downwardly angled peripheral portion 48. By downwardly angled, it is meant that the peripheral portion 48 slopes downwardly towards the securing flange 24, as indicated in FIG. 2.

The peripheral portion 48 preferably includes the plurality of elongated ventilation slots 20 formed around the peripheral portion 48 to enhance the ease with which air may be exhausted into the outside atmosphere. It will be appreciated that while the cover member 18 is shown having a generally square shape, it could also just as easily be circular in shape, oval-shaped or a wide-variety of other shapes to provide a desired aesthetic appearance. It will also be noted that the ventilation slots 20 are preferably omitted from a portion of the peripheral portion 48. This is to enable the cover member 18 to be installed on a horizontal wall portion of the dwelling 10 without providing upwardly facing openings for water to enter the interior area of the cover member 18. Accordingly, the cover member 18, shown in FIG. 7, would be installed with the peripheral portion 48*a* facing up to thus help prevent water from entering the interior area of the cover member 18.

Referring now to FIG. 8, the structure of the internal area 52 of the cover member 18 can be seen. A plurality of securing members 54 are integrally formed with an interior surface 56 of the cover member 18. The securing members 54 are further spaced-apart from one another such that they reside along each one of the four quadrants of the peripheral portion 48 and protrude outwardly generally perpendicular to the central portion 46. Each securing member 54 comprises a flexible latching arm 58 having a lock bead 54*a* which is adapted to releasably interengage with the integrally formed shoulder portions 38 on the base member 16, as will be explained more fully momentarily. Each of the securing members 54 is further supported by a pair of braces 60 which are integrally formed with an interior surface 62 of each quadrant of the peripheral portion 48. The cover member 18 is molded, and preferably injection molded, as a single piece component from a suitably high-strength plastic such as polypropylene or polystyrene.

Referring now to FIG. 9, the cover member 18 is shown in a first mounting position secured to the base member 16. In this position, the flexible latching arms 58 are interengaged with a first one 38*a* of the shoulder portions 38 (FIG. 3), to thereby position the cover member 18 in a first position at a first distance from the securing flange 24. Pushing the cover member 18 further toward the securing flange 24 causes the flexible latching arms 58 to engage a second one 38*b* of the integrally formed shoulder portions 38, to thereby place the cover member 18 in a second position even closer to the securing flange 24. The interengagement of the flexible latching arms 58 and the shoulder portions 38 are shown in cross-section in FIG. 11.

The vent apparatus 12 is secured to the exterior surface of the dwelling 10 (FIG. 1) by first positioning the base member 16 over a pre-cut opening (not shown) in the soffit 14 or other area of the dwelling 10. The securing flange 24 is then secured by nails or conventional threaded screws to the exterior surface of the dwelling 10. The cover member 18 may then be positioned over the base member 16 and a slight force exerted on the central portion 46 of the cover member 18 to cause the lock beads 58*a* of the flexible latching arms 58 to engage with the locking portions 36 of the base member 16. At this point, the cover member 18 is releasably secured to the base member 16. By releasably secured it is meant that the cover member 18 may be removed by simply pulling outwardly on the cover member 18 to urge the cover member 18 away from the base member 16.

Figure 12:
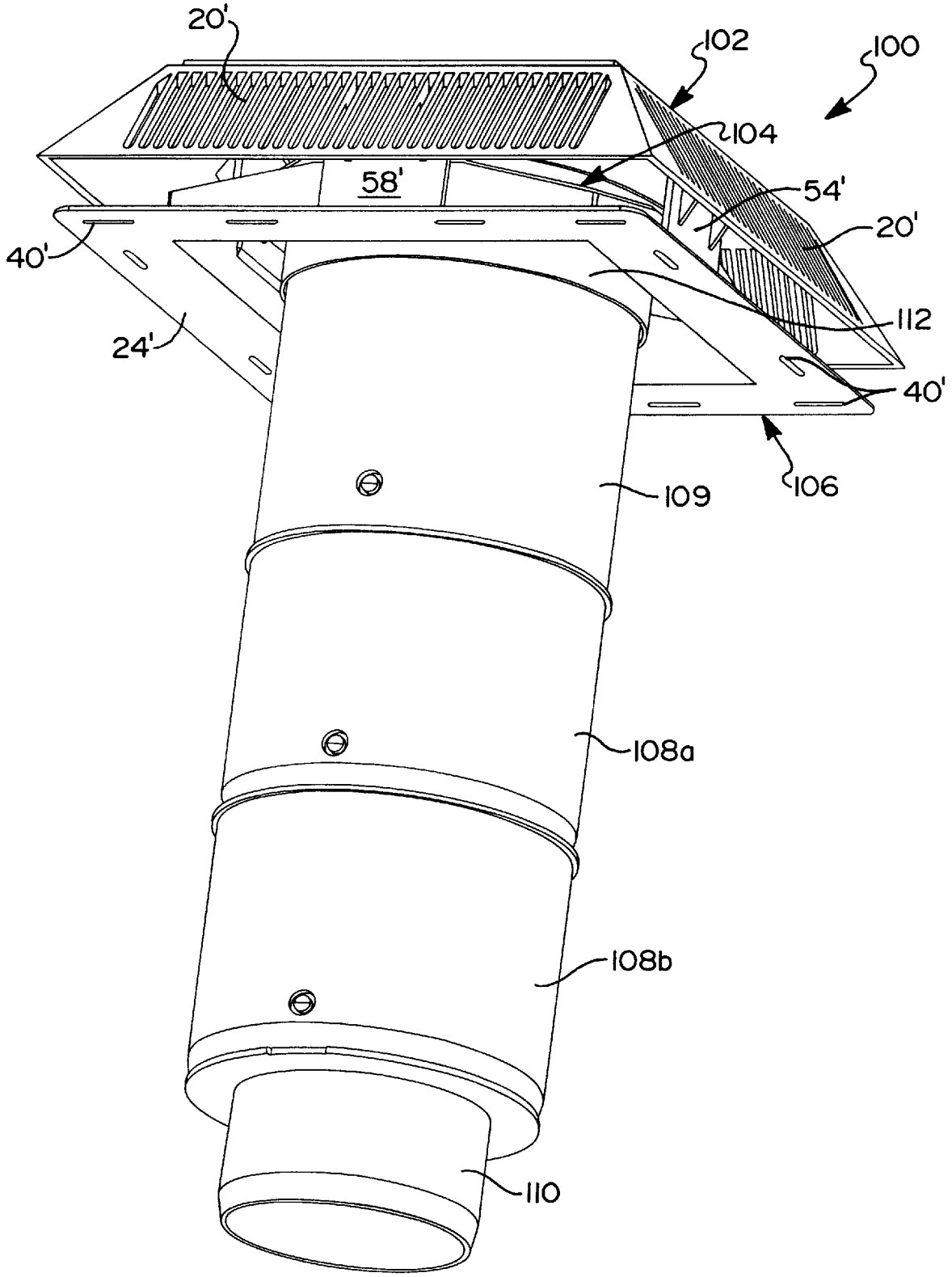
FIG. 12 is a perspective view of a soffit vent apparatus in accordance with an alternative preferred embodiment of the present invention.

Referring now to FIG. 12, there is shown a soffit vent apparatus 100 in accordance with an alternative preferred embodiment of the present invention. The apparatus 100 generally comprises a cover member 102, a screen 104 and a base member 106. In the drawing of FIG. 12, a three inch length of duct work 109 is shown fixedly secured to the base member 106 such as by spin welding. Two additional three inch lengths of duct work 108*a* and 108*b* are also shown coupled to each other and to the length of duct work 109, together with an adapter 110 shown secured to the duct work length 108*b*. It will be appreciated, immediately, that the two lengths of duct work 108*a* and 108*b* provide for a total length of six inches, which when added with the three inch length 109 provides a total length of nine inches, which is long enough to extend through a standard six inch thick wall. The adapter 110 serves as a reducer to enable the four inch diameter section of 108*b* to be coupled to a three inch diameter section of duct work. Thus, the sections of duct work 108*a* and 108*b* allow the apparatus 100 to be used with walls having varying thicknesses.

Figure 13:
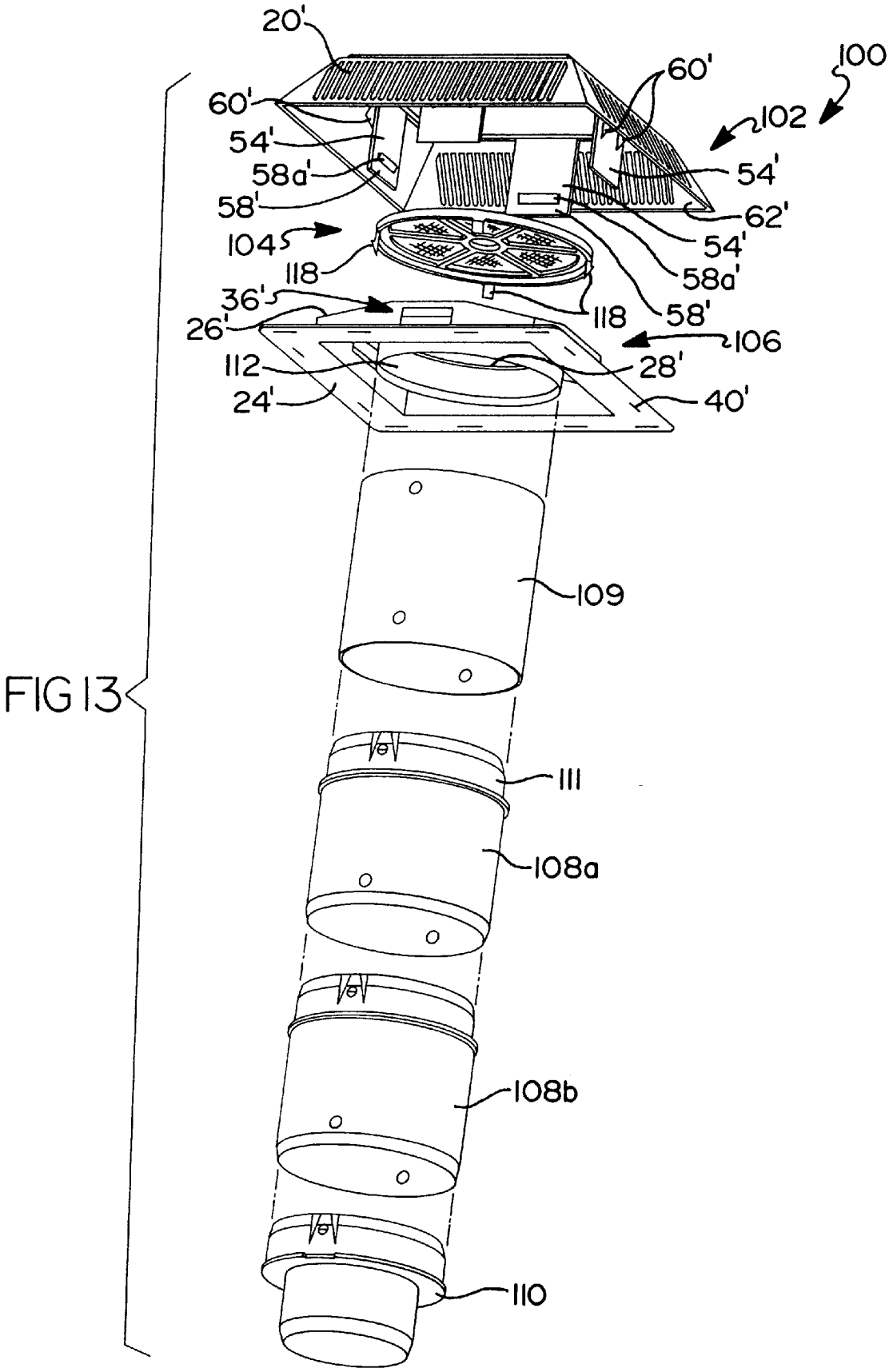
FIG. 13 is an exploded perspective view of the various components of the soffit vent apparatus of FIG. 12.

Referring to FIG. 13, the cover member 102 is identical in construction to the cover member 18 shown in FIGS. 7 and 8. Accordingly, like portions of the cover member 102 have been designated with the same reference numerals used in FIGS. 7 and 8, but with the addition of a prime ("′") designator. The base member 106 is also substantially identical to the base member 16 shown in FIGS. 3–6. Accordingly, the reference numerals for the various portions of the base member 106 conform to those used in FIGS. 3–7, but with a prime designator added to each numeral.

With further reference to FIG. 13, one difference between the base member 106 (shown in FIG. 13) and the base member 16 (shown in FIGS. 3–6) is the addition of a cylindrical member 112 secured to an inner surface 114 of the base member 106 in such a manner so as to project generally perpendicularly outwardly from the inner surface 114. With brief reference to FIG. 16, the uppermost surface 30′ of the base member 106 also includes a plurality of openings 116 spaced generally equidistant from one another.

With further reference to FIGS. 13–15, the screen 104 is shown in greater detail. It is a principal advantage of the apparatus 100 that the screen 104 is able to prevent the entry of small insects such as flies, bees, and even very small mammals into the duct work 108. The screen 104 is manufactured by injection molding a suitably high-strength plastic such as polypropylene or polystyrene together with a section of conventional screen such as aluminum or fiberglass screening, placed in the mold tool. The resulting screen 104 comprises an integrally formed high-strength plastic frame 104*a* having screening 104*b* molded in-between the members of the frame 104*a*. Alternatively, the screening 104*b* could be secured over the frame 106 by appropriate threaded fasteners or even adhesives. It will, therefore, be appreciated that the screening 104*b* could be secured to the frame 104*a* through a variety of methods.

With further reference to FIGS. 14 and 15, and particularly to FIG. 14, the screen 104 includes integrally formed locking arms 118 spaced generally equidistant from one another about the outermost periphery 105 of the frame 104*a*. The locking arms 118 are slightly resilient to allow for a small degree of deflection when the screen 104 is secured to the base member 106. With specific reference to FIG. 15, each locking arm 118 includes a ledge portion 120 which protrudes outwardly just slightly of an outer peripheral edge portion 122 of the screen 104. An angled portion 123 on each locking arm 118 also helps to allow the locking arms 118 to be secured to the base member 106.

The screen 104 can be readily removed once engaged with the base member 106 for cleaning. It is releasable in that it can be disengaged with the end of a screwdriver or other like tool by pressing inwardly on the locking arms 118 while lifting the screen 104 away from the base member. Thus, if for some reason it becomes necessary to gain access to the interior of the duct work 108 or to clean the screen 104, the screen 104 can be removed.

Figure 17:
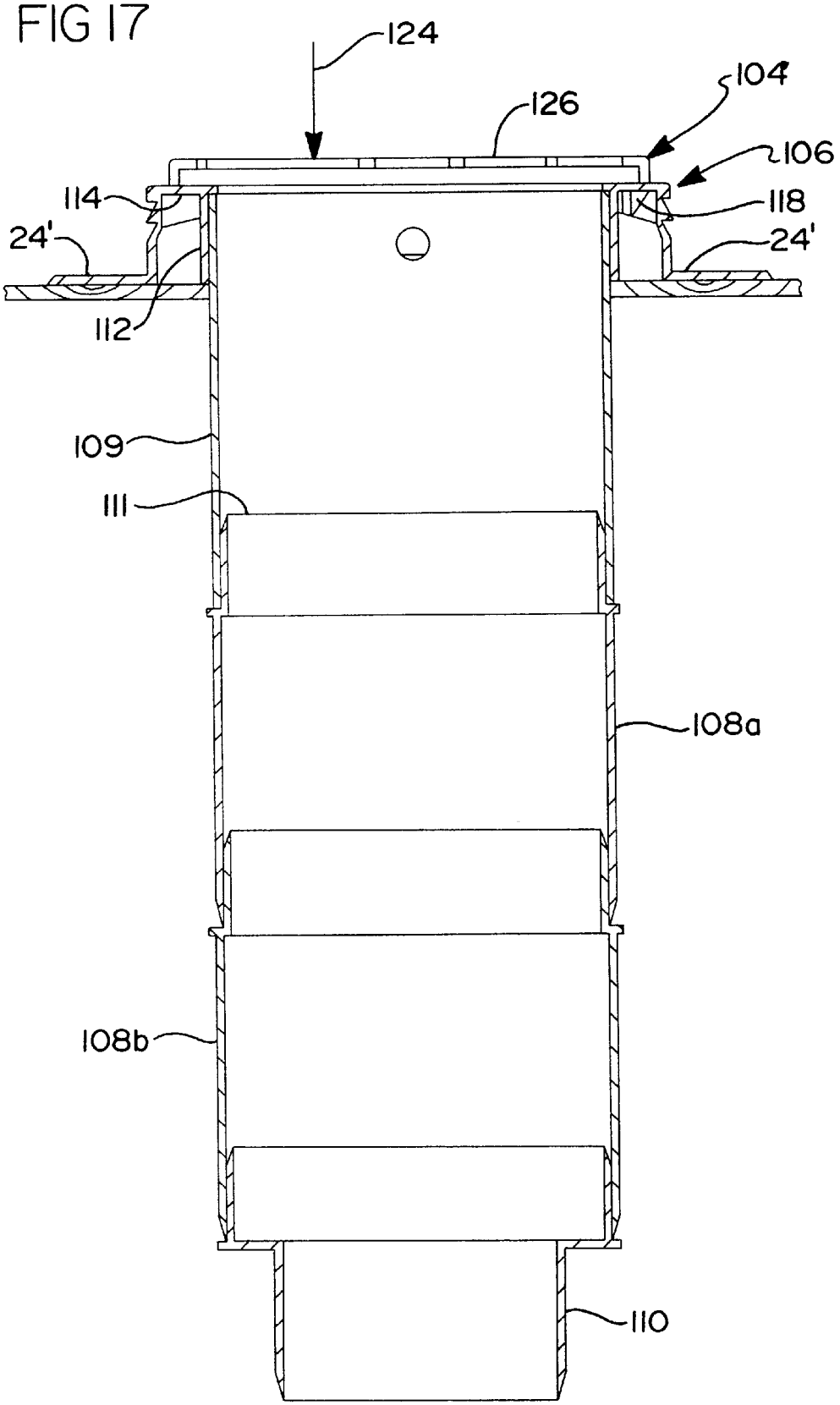
FIG. 17 is a cross-sectional side view of the screen secured to the base member, and also a section of duct work positioned within the cylindrical member.

With reference to FIG. 17, the screen 104 is secured to the base member 106 by aligning the screen 104 such that the locking arms 118 are positioned over the openings 116 in the base member 106. A downward force in accordance with directional arrow 124 is then applied to a top portion 126 of the screen 104 which causes each of the locking arms 118 to be deflected radially inwardly as the angled portions 123 each are urged along edges of the openings 116. When the angled portions 123 pass completely past the openings 116, the resiliency of each locking arm 118 causes it to snappingly engage within its associated opening 116. Once secured to the base member 106, the screen 104 cannot be readily removed or otherwise uncoupled from the base member 106 due to the interfering relationship of the ledge portions 120 with the openings 116. Most importantly, the screen 104 prevents the entry of insects such as bees, wasps, flies and even very small mammals through the opening 28' in the base member 106.

With further reference to FIG. 17, the cylindrical member 112 has an inner diameter sufficiently large to accept a four inch diameter section of duct work 108 therein. Of course, it will be appreciated that the cylindrical member 112 could be formed having other diameters. However, a diameter sufficient to accept a four inch section of duct work, which is common in residential and commercial buildings, enables not only four inch duct work to be quickly coupled to the base member 106, but also smaller diameter sections of duct work to be coupled through the use of the adapter 110 shown in FIGS. 12 and 13. The cylindrical member 112 is preferably spin-welded onto the inner surface 114 (FIG. 17) of the base member 106, but it will be appreciated that it could also be integrally formed with the base member 106 during a molding process. Similarly, the length of duct work 109 is preferably spin-welded onto the interior surface of the cylindrical member 112.

To assemble the apparatus 106, the base member 106 is aligned over the section of duct work 108*a* such that an outer edge portion 111 (FIG. 13) of the duct work 108*a* is aligned with the length of duct work 109 and inserted into the length of duct work 109. The length of duct work 108*b* may then be coupled to length 108*a* in the same manner, and the adapter 110 then coupled to duct work section 108*b*. The securing flange 24' is then positioned flush against the exterior of the building with the assembled lengths of duct work 108*a* and 108*b*, and adapter 110 extending into the opening in the building exterior. The securing flange 24' is then secured to the exterior surface of the building by nails or threaded screws placed through the openings 40'. The screen 104 can then be secured to the base member 106 as described herein. Subsequently, the cover member 102 is secured to the base member 106 so as to enclose the screen 104 between it and the base member 106. The apparatus 100 thus forms a compact, relatively inexpensive and simple to assemble assembly which effectively prevents the intrusion of flying insects and other small mammals into the duct work coupled to the apparatus 100. Importantly, the screen 104 of the apparatus 100 does not add appreciably to the overall outer dimensions of the apparatus, its cost or complexity of assembly.

The preferred embodiments of the present invention thus forms a light-weight, relatively inexpensive and yet easy to manufacture and install assembly which may be used to help direct air exhausted from interior rooms of a dwelling to the external atmosphere, or simply used as a vent. The preferred embodiments are also each compact and can be installed without special and/or expensive tools.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method of making a vent apparatus, said method comprising:

forming a base member including a securing flange which allows the base member to be secured to an exterior surface of a building wherein the securing flange comprises a planar flange for enabling external fastening elements to be used to secure the planar flange to the exterior surface of the building;

forming an attaching portion on the base member which protrudes outwardly from the securing flange away from the exterior surface of the building;

forming an opening in the attaching portion;

forming a locking portion in the attaching portion; and forming a cover member having a securing member being of dimensions for enabling the cover member to be positioned at least partially over the attaching portion of the base member wherein the securing member is engageable with the locking portion of the base member to secure the cover member to the locking portion without external fastening elements such that the cover member is adjustably spaced-apart from the attaching portion at a plurality of predetermined distances from the attaching portion.

2. The method of claim 1 further comprising forming a plurality of openings in the securing flange which enable the securing flange to be secured to the exterior surface of the building.

3. The method of claim 1 further comprising forming a plurality of elongated slots spaced-apart from one another about the securing flange which enable the securing flange to be secured to the exterior surface of the building.

4. The method of claim 1 further comprising forming the locking portion into at least one integrally formed shoulder portion protruding from the attaching portion.

5. The method of claim 4 further comprising forming the securing member of the cover member into a flexible latching arm adapted to interengage with the shoulder portion of the base member to enable the cover member to be releasably secured to the base member.

6. The method of claim 1 further comprising:

forming the attaching portion into a generally square-shaped, raised portion having an uppermost surface; and forming a plurality of corner portions on the uppermost surface which slope downwardly towards the securing flange.

7. The method of claim 1 further comprising providing a screen interposed between the base member and the cover member which restricts entry of insects and small mammals into the base member without impeding airflow through the apparatus.

8. The method of claim 7 wherein the screen comprises a frame, said method further comprising:

forming a plurality of projecting locking arm members on the frame; and forming a plurality of openings on the base member in alignment with the locking arm members such that the locking arm members can be secured within the openings to thereby enable the screen to be secured to the base member.

9. A method of forming a vent apparatus, said method comprising:

forming a base member having an attaching portion with a securing flange which enables the base member to be secured to an exterior surface of a structure;

forming a plurality of openings in the securing flange which are spaced-apart from one another;

integrally forming a raised attaching portion with the securing flange wherein the raised attaching portion has a central opening and a plurality of locking portions;

forming a cover member adapted to be placed over the base member and having dimensions sufficiently large to cover the base member;

forming a plurality of securing members on the cover member which are adapted to releasably engage with the locking portions of the base member in an manner to secure the cover member at a plurality of predetermined distances from the base member.

10. The method of claim 9 further comprising forming the openings into elongated slots.

11. The method of claim 9 further comprising forming each locking portion into a plurality of shoulder portions integrally formed with the attaching portion.

12. The method of claim 9 further comprising forming the attaching portion into a generally square-shaped portion having a plurality of corner portions sloping downwardly toward the securing flange.

13. The method of claim 9 further comprising forming the securing member of the cover member into a flexible latching arm adapted to releasably engage with a respective one of the integrally formed, protruding shoulder portions of the base member.

14. The method of claim 9 further comprising:

forming the cover member to include a central portion and a downwardly sloping peripheral portion; and forming a plurality of openings in the peripheral portion to further facilitate airflow from the opening outwardly of the cover member to an external environment.

15. The method of claim 9 further comprising injection molding the base member from a thermoplastic material.

16. The method of claim 9 further comprising injection molding the cover member from a thermoplastic material.

17. The method of claim 9 further comprising providing a screen positioned between the base member and the cover member for restricting the entry of insects and small mammals into the base member without impeding airflow through the apparatus.

18. The method of claim 17 wherein the screen includes a frame, said method further comprising the steps of:

forming a plurality of projecting locking arms on the frame;

forming a plurality of openings in the base member which are positioned to align with the locking arm members to thereby enable the screen to be secured to the base member in close proximity to the base member wherein the screen is completely covered by the cover member when the cover member is secured to the base member so as not to be visually apparent once the apparatus is secured to the exterior surface of the structure.

19. The method of claim 9 further comprising forming a cylindrical portion on the base member which is positioned to extend from the central opening for accepting a section of external duct work therein.

20. A method of forming a vent apparatus for communicating with ventilation duct work of a building, said method comprising:

forming a base member having a securing flange;

integrally forming an attaching portion with the securing flange;

forming a plurality of openings in the securing flange which are spaced-apart therealong to enable the securing flange to be secured via external fastening members to an exterior surface of the building;

forming an opening in the attaching portion;

integrally forming a plurality of locking portions on the attaching portion which are spaced about the attaching portion;

forming the attaching portion to protrude outwardly from the securing flange;

forming a cover member having dimensions sufficiently large to cover the base member and including a plurality of flexible latching arms protruding from an interior surface thereof wherein the latching arms are operable to releasably engage with the locking portions of the base member at a plurality of predetermined positions relative to the base member to secure the cover member in adjustable spaced-apart relationship to the base member to thereby permit airflow outwardly of the opening in the base member and between the cover member and the base member.

21. The method of claim 20 further comprising forming each locking portion into at least one integrally formed shoulder portion for releasably engaging with an associated one of the flexible latching arms of the cover member.

22. The method of claim 20 further comprising:

forming an uppermost, generally square-shaped surface on the raised attaching portion of the base member; and forming a plurality of corner portions on the uppermost surface which slope downwardly toward the securing flange.

23. The method of claim 20 further comprising injection molding the base member from a thermoplastic material.

24. The method of claim 20 further comprising injection molding the cover member from a thermoplastic material.

25. The method of claim 20 further comprising:

forming each locking portion into a plurality of integrally formed shoulder portions which are adapted to releasably engage with a respective one of the flexible latching arms to thereby enable the cover member to be adjustably positioned in spaced-apart relation to the base member in a first position and a second position.

26. The method of claim 20 wherein the cover member comprises a central portion and an angled peripheral portion, said method further comprising:

forming a plurality of ventilation slots in the peripheral portion for further enhancing the airflow outwardly of the opening in the base member to an external environment.

27. The method of claim 20 further comprising:

providing a screen securable to the base member;

forming the screen to have outer dimensions sufficiently small to fit within an interior area of the cover member when the cover member is secured to the base member so as not to be visible when the cover member is secured to the base member, and yet sufficiently large to completely cover the opening.

28. The method of claim 27 further comprising:

forming a cylindrical portion on the base member which extends from an inner surface of the attaching portion wherein the cylindrical portion is adapted to engage with a similarly sized section of duct work of the building when the base member is secured to the exterior surface of the building.

29. A method of forming a vent apparatus, said method comprising:

forming a base member having a securing flange for securing the base member to an exterior surface of a building;

forming an attaching portion which protrudes outwardly from the securing flange;

forming an opening in the attaching portion;

forming a locking portion in the attaching portion;

forming a cover member having a securing member and being of dimensions for enabling the cover member to be adjustably positioned at least partially over the attaching portion of the base member; and providing a screen interposed between the cover member and the base member wherein the screen has dimensions enabling it to be completely covered by the cover member when the cover member is positioned over the screen wherein the securing member is engageable with the locking portion of the base member to secure the cover member to the locking portion such that the cover member is spaced-apart from the attaching portion at one of a plurality of predetermined positions from the attaching portion.

30. The method of claim 29 further comprising forming a cylindrical portion on the base member which is in communication with the central opening for accepting a portion of an external section of duct work.

31. The method of claim 29 further comprising:

forming the screen into a generally circular frame-like member having an air-permeable screening secured thereto;

forming a plurality of locking arm members on the frame-like member which are spaced generally equal distances apart from one another;

forming a plurality of corresponding openings in the base member for accepting the locking arm members and enabling the screen to be secured to the base member such that the screen cannot be readily removed from the base member;

forming the screen to have outer dimensions which enable it to be completely covered by the cover member such that the screen is not visible when the apparatus is secured to the building.

32. The method of claim 29 further comprising:

fixedly securing a cylindrical member to the base so as to extend outwardly of the base member;

permanently securing a first length of duct work to the cylindrical member;

removably securing a second length of duct work to the first length of duct work; and removably securing a third length of duct work to the second length of duct work wherein the first, second, and third lengths of duct work have a total length sufficient to extend through a standard six inch deep wall.

33. The method of claim 32 further comprising:

providing an adapter member for enabling the third length of duct work to be coupled to an external length of tubing having a different diameter than the third length of duct work.

* * * * *